US007543719B2

(12) United States Patent
Young et al.

(10) Patent No.: US 7,543,719 B2
(45) Date of Patent: Jun. 9, 2009

(54) NAPKIN DISPENSER

(75) Inventors: Michael Young, Mukwanago, WI (US); Paul Omdoll, Waukesha, WI (US); Nisha Gupta, Waukesha, WI (US); Scott Collins, Milwaukee, WI (US); James Walsh, Milwaukee, WI (US); Craig Fluegge, Milwaukee, WI (US)

(73) Assignee: The Colman Group, Inc., Elkhorn, WI (US)

( * ) Notice: Subject to any disclaimer, the term of this patent is extended or adjusted under 35 U.S.C. 154(b) by 10 days.

(21) Appl. No.: 10/891,429

(22) Filed: Jul. 14, 2004

(65) Prior Publication Data

US 2005/0150898 A1 Jul. 14, 2005

Related U.S. Application Data

(63) Continuation-in-part of application No. 29/186,425, filed on Jul. 15, 2003, now Pat. No. Des. 493,312.

(51) Int. Cl.
*B65H 1/12* (2006.01)

(52) U.S. Cl. ..... 221/52; 221/56; 221/57; 221/59

(58) Field of Classification Search ..... 221/52, 221/57, 36, 37, 38, 41, 44, 45, 48, 59, 62, 221/63

See application file for complete search history.

(56) References Cited

U.S. PATENT DOCUMENTS 1,513,792 A * 11/1924 Arelt ..... 221/56
3,095,996 A * 7/1963 Babin ..... 221/52
3,203,586 A * 8/1965 Downham ..... 221/55
3,208,636 A * 9/1965 Filipowicz ..... 221/57
3,370,748 A * 2/1968 Koerper et al. ..... 221/59
3,765,565 A 10/1973 Fietzer et al.
3,777,931 A * 12/1973 Fleming ..... 221/57
4,127,954 A * 12/1978 Hausmann ..... 42/50
4,155,484 A 5/1979 Pastore
4,329,001 A 5/1982 Filipowicz et al.
4,706,844 A 11/1987 Omdoll et al.
4,838,454 A 6/1989 Salzmann et al.
5,076,466 A * 12/1991 Petterson et al. ..... 221/46
5,102,007 A 4/1992 Petterson et al.
5,131,561 A * 7/1992 Casperson et al. ..... 221/35
5,156,293 A 10/1992 Petterson et al.
6,230,929 B1 * 5/2001 Phelps et al. ..... 221/49
6,334,544 B1 1/2002 Christensen et al.

(Continued)

OTHER PUBLICATIONS

SCA Tissue, Xpressnap Brochure.

(Continued)

*Primary Examiner*—Gene Crawford
*Assistant Examiner*—Timothy R Waggoner
(74) *Attorney, Agent, or Firm*—Boyle Fredrickson, S.C.

(57) ABSTRACT

A dispenser having a faceplate that can be removed and attached to the housing of the dispenser without the use of tools. The dispenser may have a track system. The track system may be positioned in or removed from the dispenser without the use of any tools. The dispenser, including the housing and/or the track system, may be curved. The faceplate may be angled away from the surface upon which the dispenser is positioned. The faceplate may also be curved away from the housing to form an interior surface in the faceplate. The interior may have features for desired dispensing characteristics.

21 Claims, 7 Drawing Sheets

U.S. PATENT DOCUMENTS 6,352,172 B1 3/2002 Chan et al.
6,378,726 B1 4/2002 Chan et al.
6,585,129 B2 7/2003 Moody et al.
6,824,007 B2 * 11/2004 Timmers et al. ..... 221/53
2003/0062375 A1 4/2003 Christensen et al.

OTHER PUBLICATIONS

Georgia Pacific, EasyNap Brochure.

* cited by examiner

FIG. 1
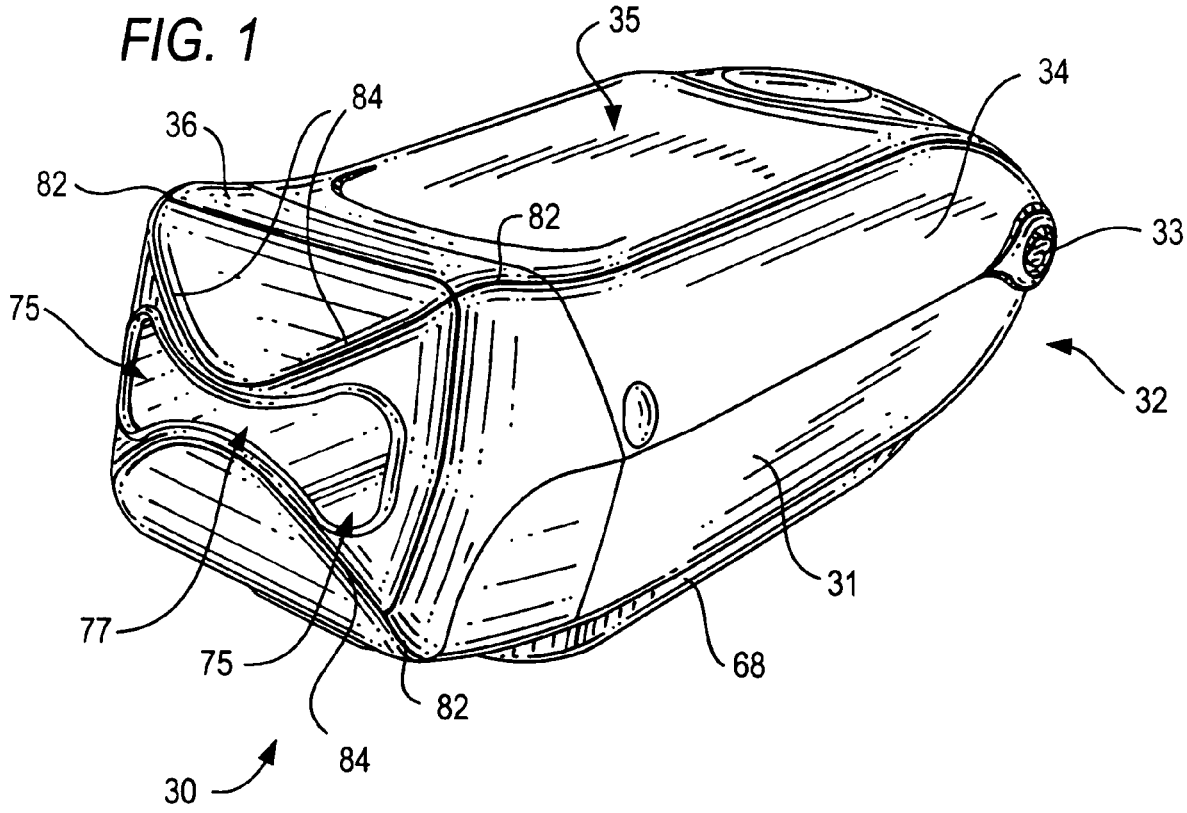
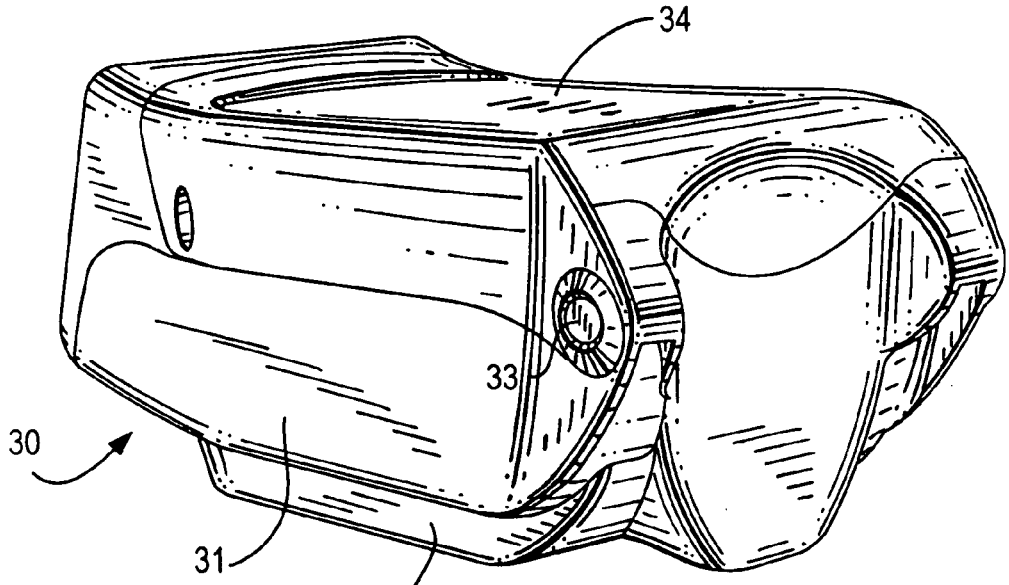
FIG. 2

NAPKIN DISPENSER

CROSS-REFERENCE TO PRIOR APPLICATION

This application is a continuation-in-part application and claims priority to U.S. patent application Ser. No. 29/186,425 filed Jul. 15, 2003 Des. 493,312 and claims priority to a United States Provisional Patent Application filed May 21, 2004, the disclosures of which are incorporated herein by reference in their entirety for all purposes.

BACKGROUND OF THE INVENTION

This invention relates generally to an apparatus for use in dispensing napkins or similar products. In particular, the invention relates to an apparatus for dispensing napkins that can be readily configured to accommodate a variety of napkin sizes, types, and styles.

Dispensers for napkins are often provided at quick service food locations. These dispensers may be positioned on a condiment serving bar, attached to a wall, or maintained on a stand. These dispensers allow food service patrons easy hygienic access to napkins.

One disadvantage of many conventional paper napkin dispensers is that they permit removal of large clumps of napkins at one time. Most paper napkins removed in this manner are wasted. Many end up scattered about an eating area, tossed as litter, or even stuffed in plumbing fixtures. When clumps of napkins are taken, dispensers quickly run out and must be refilled inconveniencing both patrons and operators of quick service food locations. This waste is expensive, time consuming, and harmful to the environment.

Another disadvantage of many conventional paper napkin dispensers is that they frequently fail to present a napkin to patrons. Napkin dispensers are easily overfilled by restaurant workers in an effort to limit the need for frequent refilling. Overfilling a napkin dispenser results in tightly packed napkins that are difficult to remove. Often this results in torn napkins that can jam the dispenser. Patrons seeking napkins are forced to stick their fingers into the dispenser and forcefully pull napkins from the dispenser. Patrons, frustrated by the dispenser, may forcefully remove a large section of napkins from the dispenser to avoid getting small, torn bits of napkins.

In an attempt to solve these and other problems associated with conventional napkin dispensers, the paper industry has introduced a napkin style call interfold. An example of this type of napkin is disclosed in U.S. Pat. No. 6,213,346 to Skerrett et al. These napkins are interfolded so that the act of removing one napkin from the dispenser draws out and presents the next napkin in the stack. A similar style of interfolding is frequently used in washroom towels and tissues, but is rather new to napkins. While this type of napkin has the potential to significantly reduce napkin waste and usage, it has not been widely adopted by the food service industry. Part of the reluctance by many in the food service industry to use interfold napkins results from the fact that virtually all conventional napkin dispensers cannot easily or efficiently dispense interfolded napkins. As a result, operators of food service establishments wishing to experiment with or use interfolded napkins must purchase new dispensers dedicated to the dispensing of interfold napkins. If the operator is not satisfied with the result, he or she has spent money for something that has no other use.

One attempt to solve this problem is disclosed in U.S. Pat. No. 6,585,129 to Moody et al. This patent discloses a retro kit that comprises a baffle plate that is attached to the faceplate of a conventional napkin dispenser. The baffle plate is purported to alter the conventional faceplate opening so that it can dispense interfolded napkins. The baffle plate, however, must be correctly attached to the conventional faceplate. Further, the baffle plate must be adhered to the conventional faceplate so that the baffle plate does not loosen during operation. Such a strongly adhered baffle plate is difficult to remove from the conventional faceplate without harming the faceplate or the baffle plate. Also, removing the baffle plate from the faceplate may leave a sticky residue on the faceplate, thereby interfering with its operation. As such, dispensers fitted with this retrofit kit are not easily changeable between conventional napkins and interfolded napkins The current dispensers suffer from certain drawbacks and limitations. Accordingly, a need exists for a dispenser that is easy to use, relatively inexpensive to manufacture, relatively compact, and solves other problems associated with the existing techniques. Of course, the present invention may be used in a multitude of situations where similar performance capabilities are required.

SUMMARY OF THE INVENTION

In one embodiment of the present invention, a napkin dispenser able to dispense different sizes and types of napkins is provided. Different sizes and types of napkins generally require different means and structure to properly dispense the napkins. Therefore, this embodiment of the present invention provides for a napkin dispenser with a faceplate that can be removed and attached without the use of any tools.

In another embodiment of the present invention, a napkin dispenser is provided with a track system positioned therein. The track system supports and directs a napkin biasing means to urge napkins towards the front of the dispenser and against the dispenser's faceplate. In one embodiment, the track system has one rail and the biasing means comprises at least one pressure plate. In another embodiment, a pressure focus device may be positioned on the pressure plate to more directly apply force to the napkins at a desired location.

In yet another embodiment of the present invention, a curved dispenser is provided such that the faceplate is angled away from the surface upon which the dispenser is positioned. In addition, to the housing of the dispenser being curved, this embodiment may include a similarly curved track system. In accordance with this embodiment, the dispenser is curved between about 10° to about 40°, most preferably between about 15° to about 30°, and most preferably about 20°.

One possible application of the present invention is in connection with napkin dispensers, many other applications are possible and references to use in connection with napkins should not be deemed to limit the uses of the present invention. While certain embodiments are discussed herein, they should not be interpreted as being the only embodiments of the present invention and other embodiments may be created without departing from the present invention. These and other objects and advantages of the present invention will become apparent from the detailed description, claims, and accompanying drawings.

DESCRIPTION OF THE DRAWINGS

FIG. 1 is a front perspective view of a napkin dispenser in accordance with one embodiment of the present invention;

FIG. 2 is a rear perspective view of a napkin dispenser in accordance with another embodiment of the present invention;

DETAILED DESCRIPTION OF THE PREFERRED EMBODIMENTS

Figure 3:
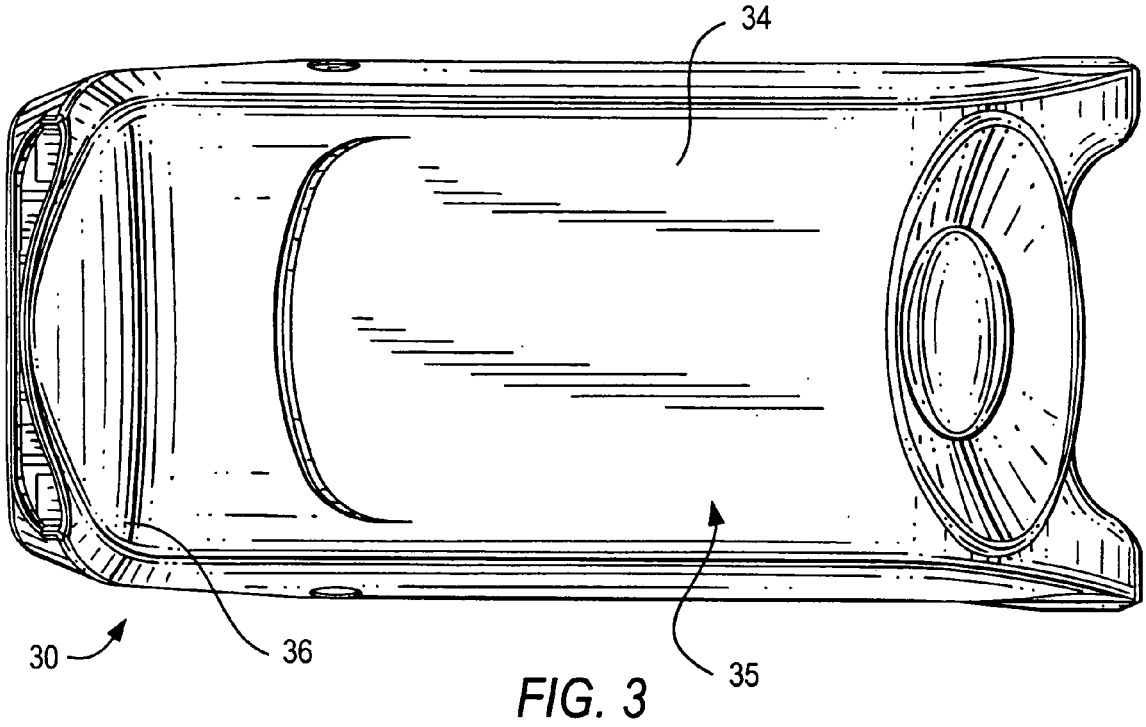
FIG. 3 is a top plan view of the napkin dispenser of FIG. 1.

Illustrative embodiments of a dispenser (identified generally as 30) in accordance with the present invention are shown in FIGS. 1 through 14. While the invention may be susceptible to embodiment in different forms, there are shown in the drawings, and herein are described in detail, certain illustrative embodiments with the understanding that the present disclosure is to be considered an exemplification of the principles of the invention, and is not intended to limit the invention to those specific embodiments illustrated and described herein. Additionally, features illustrated and described with respect to one embodiment could be used in connection with other embodiments.

The present invention provides a napkin dispenser 30 able to dispense different sizes and types of napkins. Generally, a single dispenser cannot dispense different sizes and types of napkins without substantial modifications. Such modification generally involves the use of tools, complicated procedures, and expensive addition components. The present invention provides for a dispenser 30 with a faceplate 36 that can be interchanged without the use of any tools. Specifically, the dispenser 30 has a housing 32 and a faceplate 36 that is removably attachable to the housing 32. For example, faceplate 36 can be interchanged with other faceplates (not shown) to accommodate different interfolded napkin sizes or to accommodate conventional non-interfolded napkins (including, specifically standard or full-fold napkins).

Figure 9:
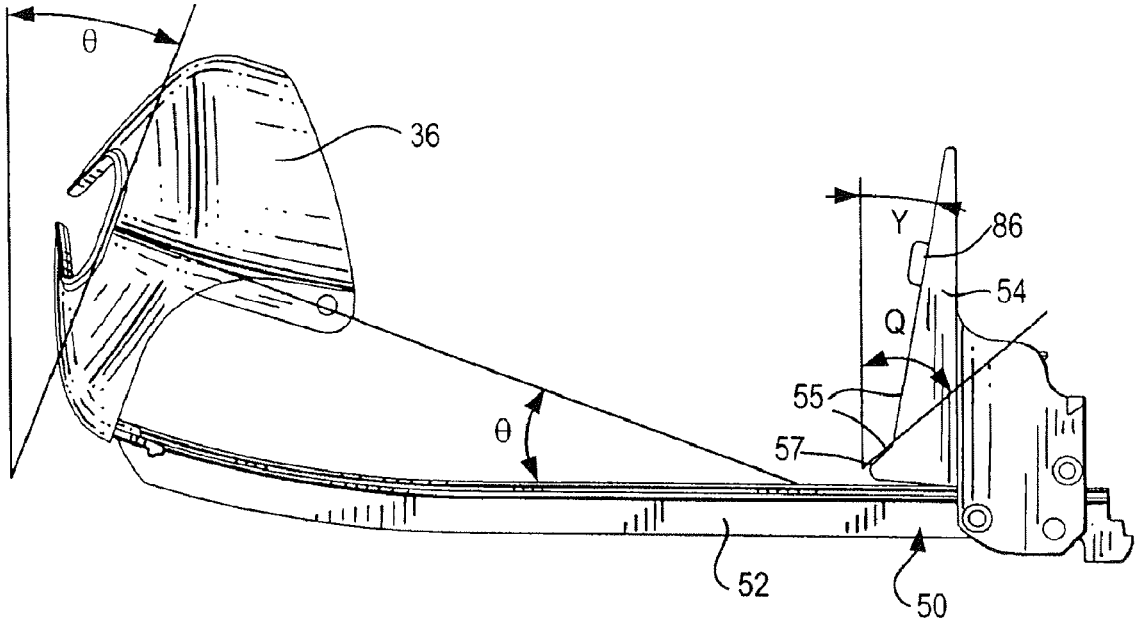
FIG. 9 is a cutaway side view of a faceplate and rail system of a napkin dispenser in accordance with one embodiment of the present invention.

Referring generally to FIGS. 1, 2, 4 and 9 the dispenser 30 of the present invention is preferably curved to provide both aesthetic and functional improvements over the prior art. As shown in FIG. 9, the dispenser is preferably curved upwardly at an angle θ from the longitudinal center line of the dispenser (or backwardly from the perpendicular). Angle θ is between about 10° to about 40°, more preferably between about 15° and about 30° and most preferably about 21°.

The dispenser 30 has a housing 32. The housing 32 may be formed of any suitable material but is preferably of plastic or metal. Attached to the front of the housing 32 is a face plate 36. In one preferred embodiment of the present invention, shown in FIG. 1, the face plate 36 forms a portion of the front of the housing 32.

Figure 4:
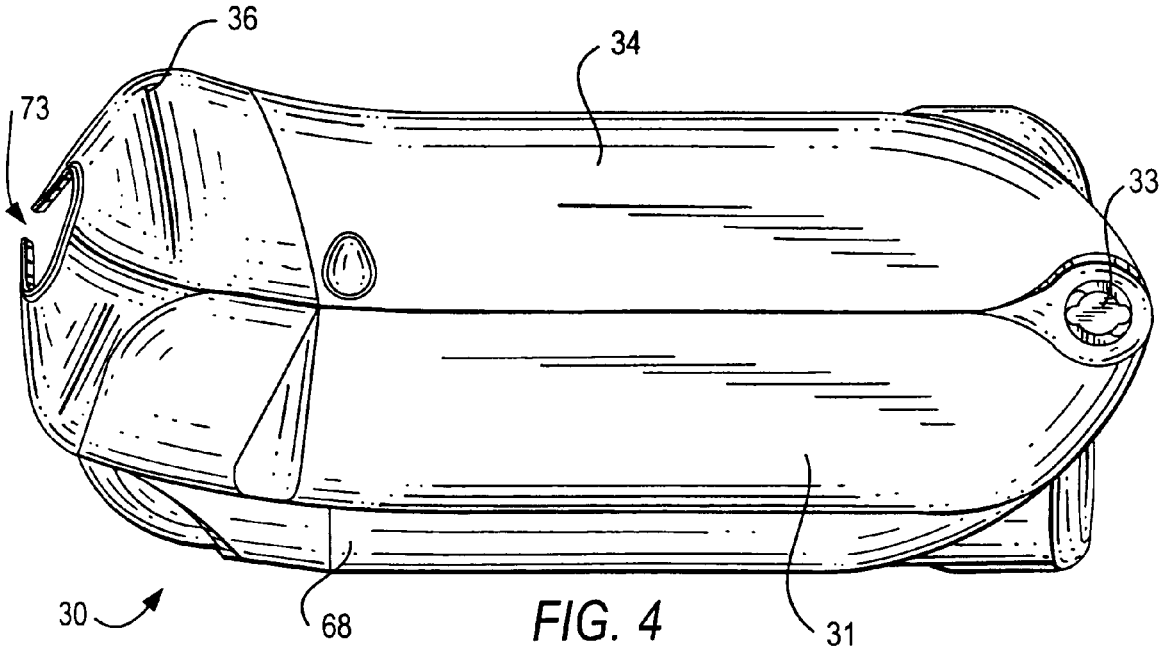
FIG. 4 is a side plan view of the napkin dispenser of FIG. 1.
Figure 14:
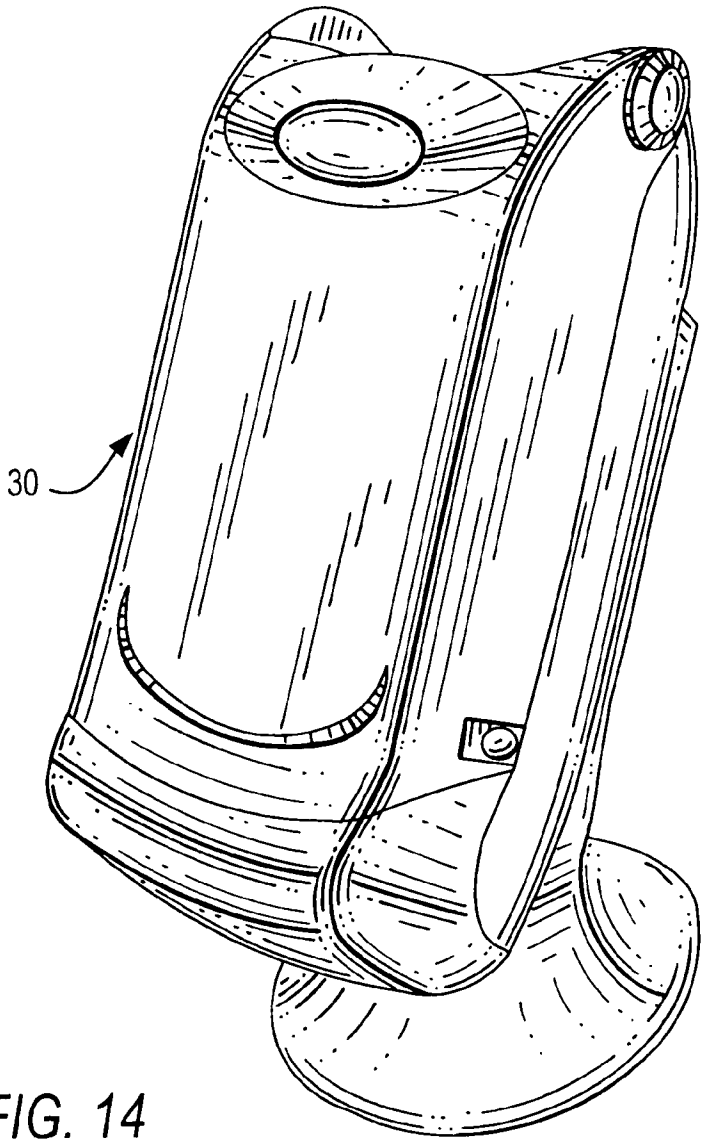
FIG. 14 is a perspective view of a napkin dispenser in accordance with one embodiment of the present invention mounted in a substantially vertical position.

As shown in FIGS. 1, 2 and 4, the housing 32 comprises a bottom portion 31 and a top portion 34. The top portion 34 is pivotally connected to the bottom portion 31 at the rear of the housing 32 at a pair of connections 33. This connection permits ready access to the inside of the housing 32. Preferably, the pivotal connection is constructed so that when the housing 32 is open, the top portion 34 does not contact the surface upon which the dispenser 30 is positioned when the top portion 34 is fully opened, regardless of the angle at which the dispenser 30 is positioned. For example, the top portion 34 will not contact a countertop portion when the dispenser 30 is positioned on the countertop portion and the top portion 34 is fully opened. Likewise, the top portion 34 will not contact a wall when the dispenser 30 is positioned on a wall and the top portion 34 is fully opened. The top portion 34 may also be connected to the bottom portion 31 so that the top portion 34 remains selectively in an open position when the dispenser 30 is mounted to a wall or placed on a stand as shown in FIG. 14 in a relatively vertical position. This preferred construction also limits the point(s) at which the top portion 34 may be removed from bottom portion 31.

Figure 8:
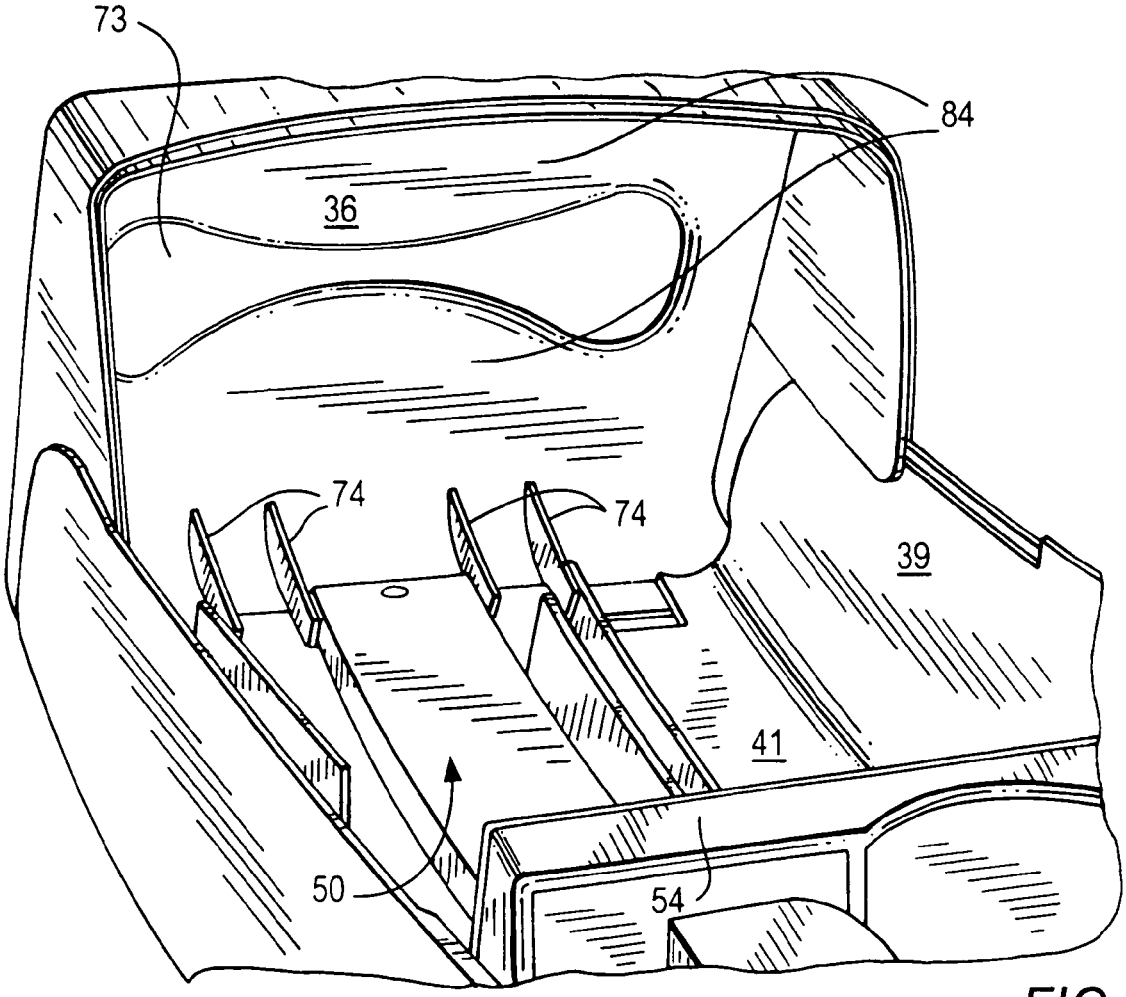
FIG. 8 is a perspective view of the napkin dispenser of FIG. 2 with the top portion opened.
Figure 10:
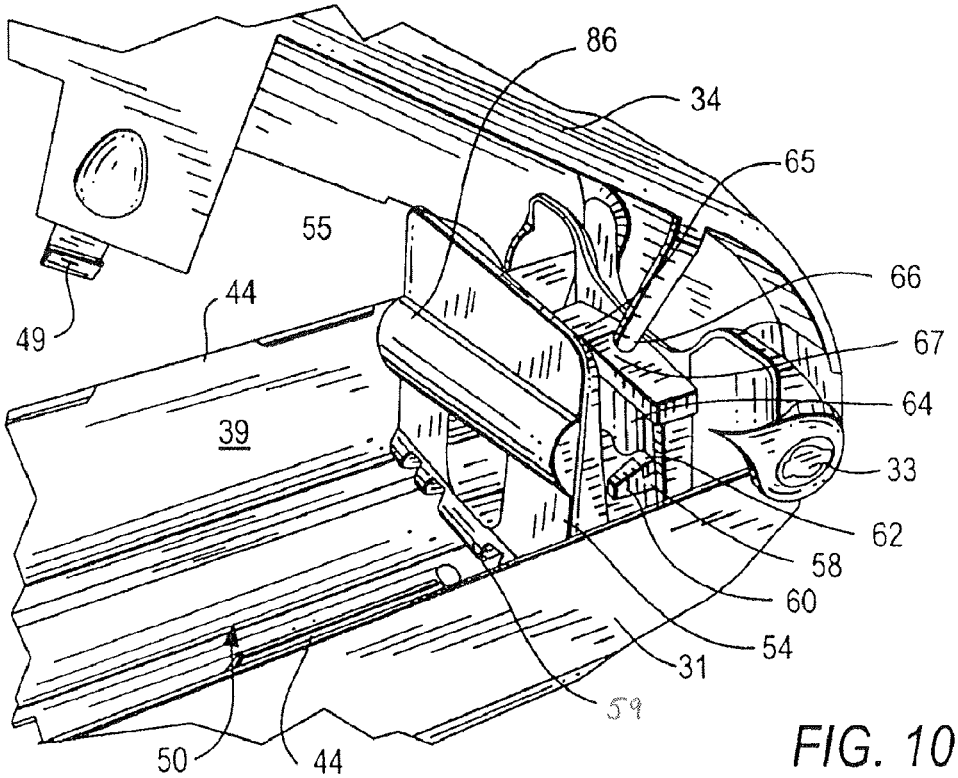
FIG. 10 is a partial perspective view of a napkin dispenser in accordance with one embodiment of the present invention shown with part of a top portion of the napkin dispenser removed.
Figure 11:
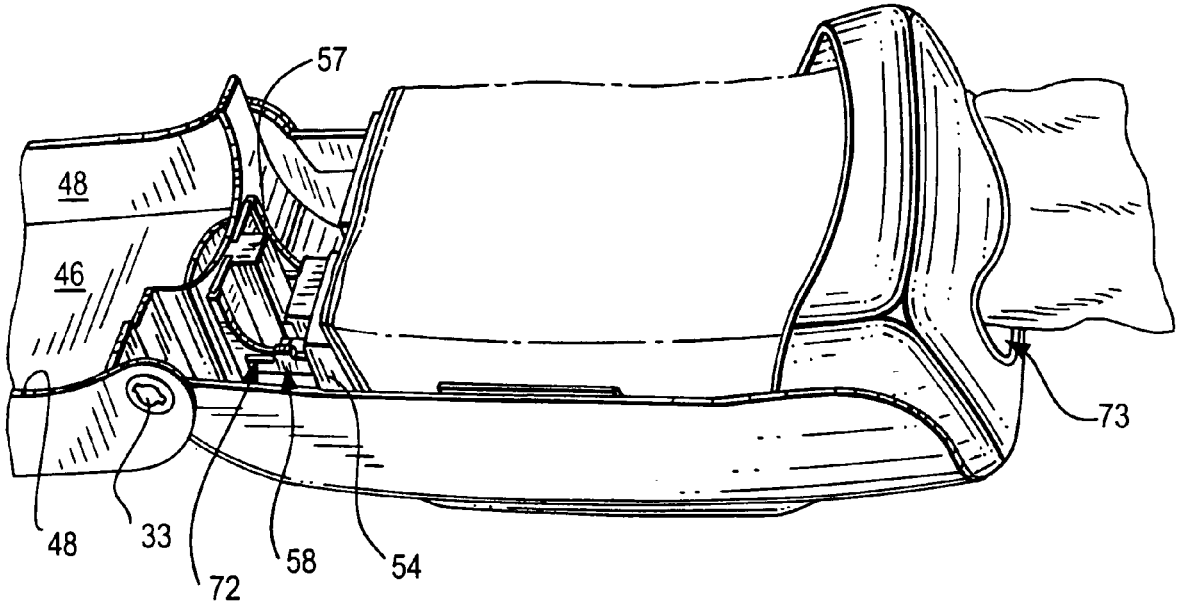
FIG. 11; is a perspective view of a napkin dispenser in accordance with one embodiment of the present invention with the top portion opened and napkins loaded into the dispenser.

As shown in FIGS. 8, 10 and 11 the bottom portion 31 has a floor 41 and walls 39. Preferably, as shown in FIG. 10, a pair of protrusions 44 are mounted on or integral with walls 39 of the housing 32 bottom portion 31. These protrusions 44 ensure the tight fit of the napkins within the housing 32, thereby facilitating a desired form of dispensing. For example, the protrusions 44 may contact the napkins and compact the napkins. The protrusions 44 may also contact the napkins and separate the napkins to prevent the dispenser from jamming.

As shown in FIG. 11, the top portion 34 has a roof 46 and walls 48. As shown in FIG. 10, the top portion 34 preferably includes at least one latch member 49 positioned on the top portion 34. The latch 49 cooperates with corresponding latch receiving areas on the bottom portion 31 to prevent the top portion 34 from being freely opened. Thus, in order to open the dispenser 30, the latch 49 must be released. The top portion 34 may be biased so that releasing the top portion 34 results in the top portion 34 opening, either partially or fully, without further significant effort from the user. Such biasing may be provided by springs, pressure, gravity, or the like.

As shown in FIGS. 1, 2 and 4 just beneath the housing 32 is a base 68. The base 68 defines the footprint of the dispenser 30 on a flat surface and provides support for the dispenser 30 when it is deployed in a horizontal manner. As shown in FIG. 1, the base 68 preferably is of a height H so that when the dispenser 30 is on a flat horizontal surface, napkins extending from the faceplate 36 do not touch the surface.

Figure 5:
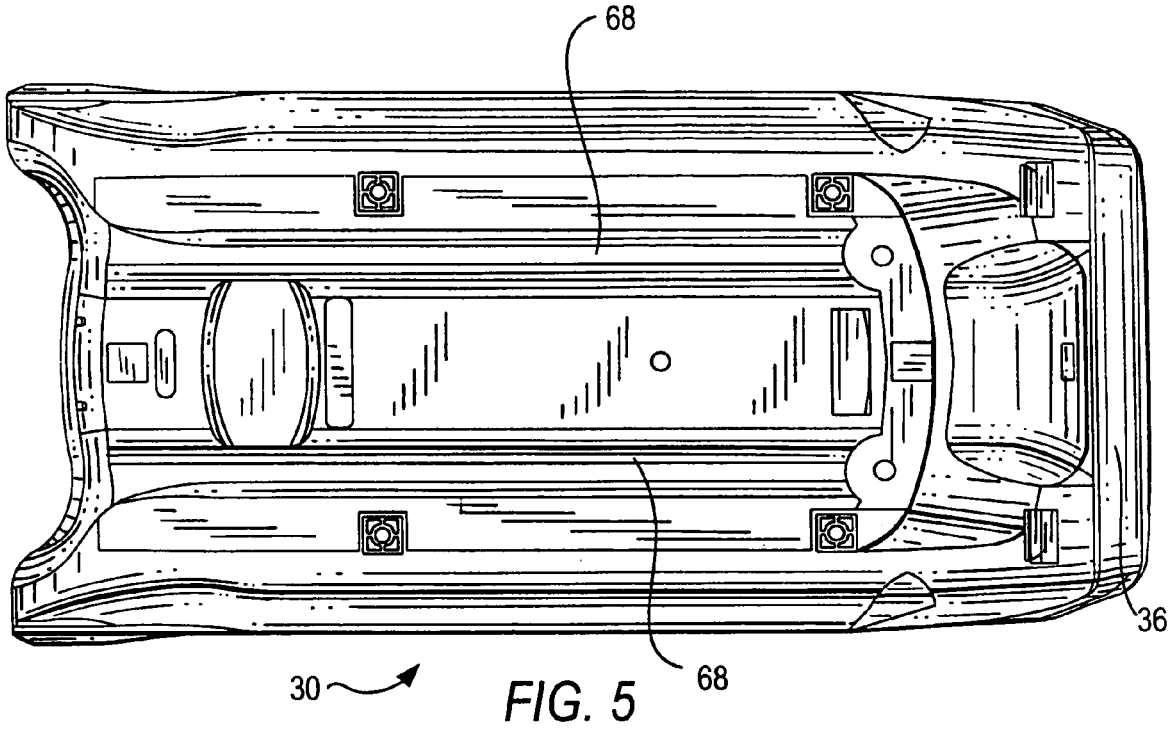
FIG. 5 is a bottom plan view of the napkin dispenser of FIG. 1

Preferably, as shown in FIGS. 1, 3 and 5 the base 68 is also configured to cooperate with a shaped nesting space 35 of the top portion 34 so that multiple dispensers 30 may be stacked on top of one another with the base 68 of one dispenser 30 self locating in the top portion 34 of another dispenser 30.

As with the housing 32, the bottom portion 31 can take a variety of shapes. For example, in one embodiment, the bottom portion 31 is curved. Preferably, the bottom portion 31 is curved between about 10° to about 40°. Preferably, the bottom portion 31 is curved at about 20°.

Figure 12:
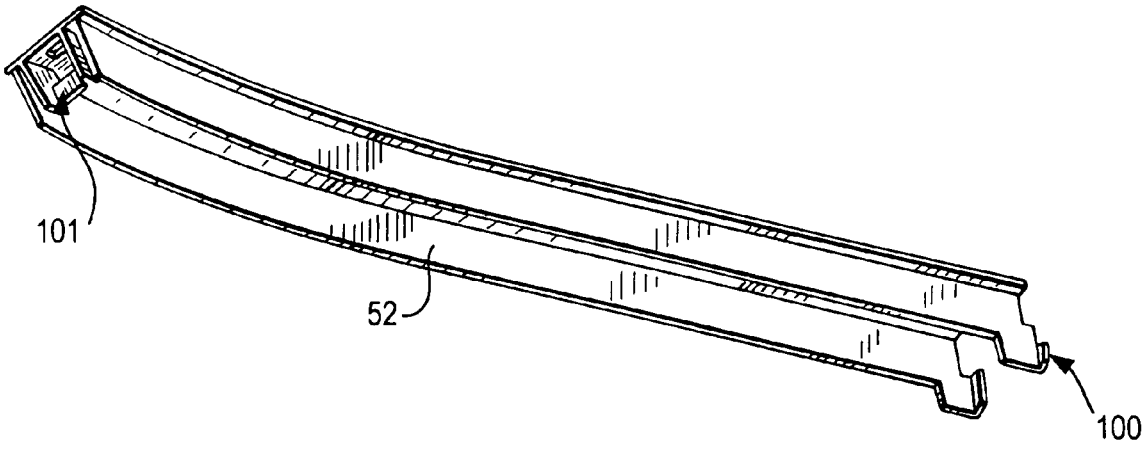
FIG. 12 is a perspective view of a rail of a napkin dispenser in accordance with one embodiment of the present invention.
Figure 13:
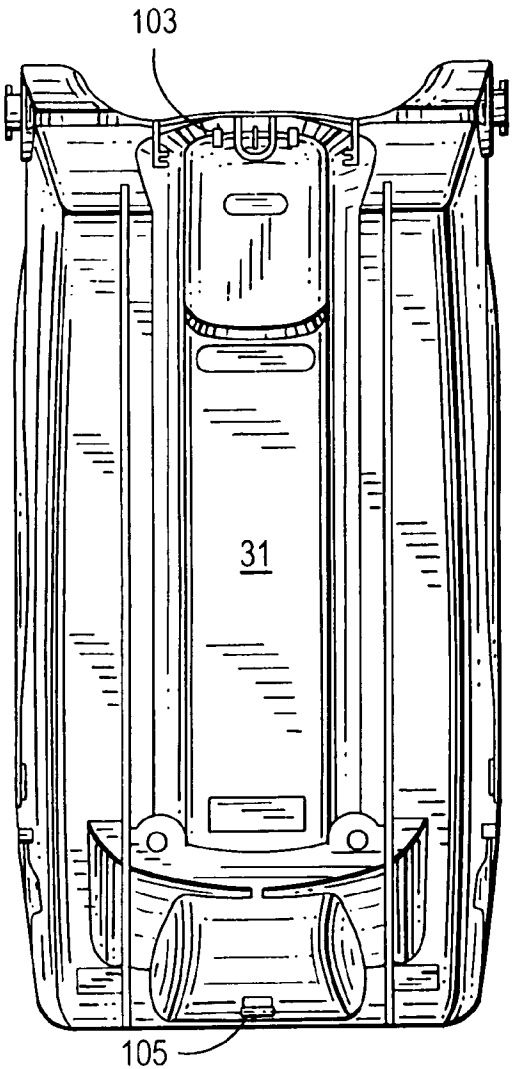
FIG. 13 is a top view of a bottom portion of a napkin dispenser in accordance with one embodiment of the present invention.

In embodiments shown in FIGS. 8, 9 and 10, a track biasing system 50 is positioned in the housing 32. The track system 50 is particularly useful when the dispenser 30 is positioned relatively horizontally with respect to the surface upon which it rests. The track system 50 urges napkins towards the faceplate 36 so that a napkin may be easily removed from the dispenser 30. Preferably, as shown in FIGS. 12 and 13, the track system 50 is attached to the housing 32 in a manner permitting it to be removed from the housing 32 without the use of any tools. The track system 50 has one rail 52 and a pressure plate 54. The pressure plate 54 rides or is guided on or by the rail 52. The pressure plate 54 is biased towards the faceplate 36. In one embodiment, the pressure plate 54 is biased towards the faceplate 36 by a constant load spring (also sometimes called a constant force spring) that is attached to the rail 52 or housing 32 and the pressure plate 54.

In one embodiment, shown in FIG. 9, the track system 50, and specifically the rail 52, is curved. In this embodiment, the track system is curved to conform to the shape of the housing 32 of the dispenser 30. As such, the track system 50 may be curved between about 10° to about 40°, preferably from about 15° to about 30°, and most preferably about 21° along its length.

The pressure plate 54 is preferably positioned with respect to the rail 52 so that the pressure plate 54 applies a generally constant force to the napkins. In one embodiment shown in FIGS. 9 and 10, the face 55 of the pressure plate 54 is at an angle Y with respect to normal from the rail 52. Angle Y is between about 0° and 20°, preferably between about 5° and 15°, and most preferably about 10°. The pressure plate 54 may be curved or otherwise shaped so that the pressure plate 54 lifts the napkins as it applies a force thereto. For example, as shown in FIG. 9, the pressure plate 54 may have a leading edge 7 forming the shape of a plow. The edge 59 is set at an angle Q with respect to normal from the rail 52. Preferably, angle Q is larger than angle Y.

In embodiments shown in FIGS. 9 and 10, the position of the pressure plate 54 is initially maintained in a retracted position by a retention mechanism 58. As shown in FIG. 10, the retention mechanism 58 has at least one extension 60 and the pressure plate 54 has at least one catch 62. The extension 60 of the retention mechanism 58 engages the catch 62 of the pressure plate 54, to maintain the pressure plate 54 in a retracted position. The pressure plate 54 is released from the retracted position by depressing a trigger 64 that lowers an extension 60, to allow the catch 62 of the pressure plate 54 to slide free. Of course, the extension 60 and/or the trigger 64 may be provided on the pressure plate 54 and the catch 62 on the retention mechanism 58. The top portion 34 has a finger 66 such that closing the top portion 34 causes the finger 66 to depress the trigger 64 and release the pressure plate 54 from the retracted position.

Preferably, as shown in FIG. 10, the retention mechanism 58 includes latch guard 65 positioned over the trigger 64. Most preferably, the latch guard 65 is removable without any tools. The latch guard 65 is not moveable when positioned over the trigger 64. The latch guard 65 has a slot 67. The slot 67 only allows the finger 66 to pass therethrough and reach the trigger 64. As such, the trigger 64 is only triggered, and the pressure plate 54 released, when the top portion 34 of the dispenser 30 is closed a predetermined amount, preferably about half-way. Therefore, the latch guard 65 prevents accidental release of the pressure plate 54. Accidental release of the pressure plate 54 could result in the pressure plate 54 traveling towards the faceplate 36 at a speed and with force capable of damaging the dispenser 30 or napkins and/or injuring a user.

Preferably, as shown in FIG. 11, the dispenser 30 has an overload protection mechanism 72 associated with the retention mechanism 58. The overload protection mechanism 72 prevents the pressure plate 54 from being moved past a safe point and jamming. The overload protection mechanism 72 may be moved by depressing the trigger 64. Movement of the overload protection mechanism 72 permits the pressure plate 54 to be moved even further away from the faceplate 36 and up small ramp portions. This permits the dispenser to be over-filled with napkins without compromising the integrity of the unit.

As discussed above the dispenser 30 has a faceplate 36 that is removably attachable to the housing 32 of the dispenser 30 without the use of any tools. The faceplate 36 of the dispenser 30 may be changed so that the dispenser 30 can properly dispense multiple types and sizes of napkins including both interfolded and non-interfolded napkins. Specifically, the faceplate 36 has an opening 73 through which napkins are available to be taken from the dispenser 30. A first faceplate is designed to dispense non-interfolded napkins with the faceplate preferably having an opening positioned near the top portion of the faceplate 36. A second faceplate as shown in FIG. 1, is designed to dispense interfolded napkins with the faceplate preferably having an opening 73 with two open areas 75 connected by a narrow aperture 77.

As noted above and shown in FIGS. 1, 2 and 4, the dispenser 30 of the present invention is preferably curved. As shown in FIG. 9, this curvature results in the faceplate 36 being angled upwardly from the majority of the housing at an angle of between about 10° to 40° from the longitudinal axis of the rear portion of the housing, preferably between about 15° to about 30°, and most preferably about 20° or 21°. As shown in FIGS. 2 and 11, this curvature, and the height H of the base 68, provide for a dispenser 30 where a napkin that is fully presented (i.e., extending through the opening 73 in a position to be engaged by a user), does not touch the surface upon which the dispenser 30 is positioned.

Preferably the faceplate 36 is shaped to facilitate optimal dispensing of napkins. In one embodiment, shown in FIG. 8, the faceplate 36 has a ramp extension 74 positioned thereon that corresponds to support structure associate with the track system 50. The ramp extension 74 serves as a bottom support and guide for the napkins to lift them and urge them forward to center them in the middle of faceplate 36.

Figure 6:
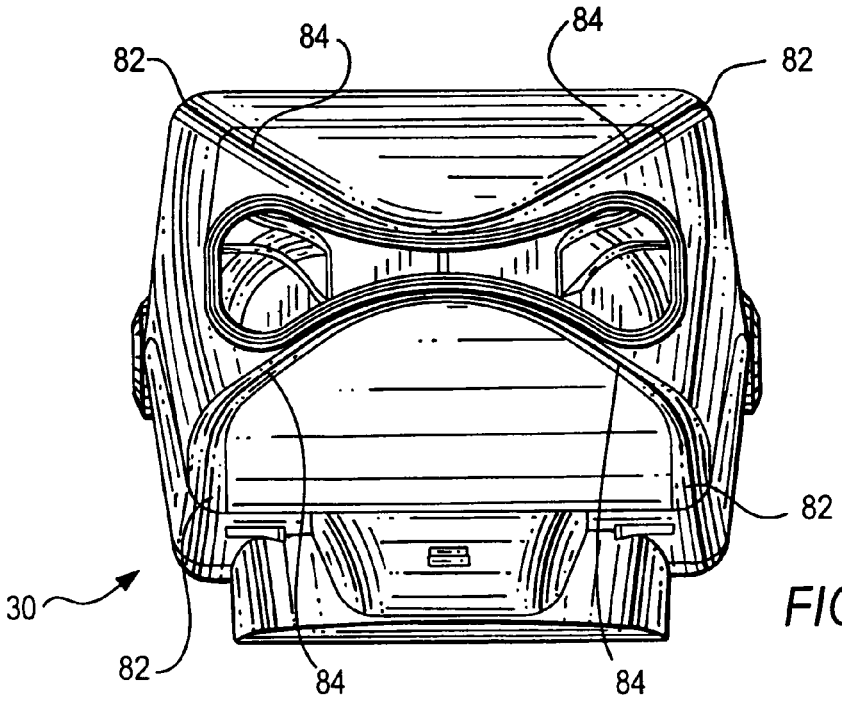
FIG. 6 is a front plan view of the napkin dispenser of FIG. 1.

As shown in FIGS. 1 and 6 the faceplate 36 preferably has a plurality of pinch points 82 located at each of the front corners of the faceplate 36. The pinch points 82 are formed so that the corners of each napkin progressively increase contact with the pinch points as the napkins move to the front of the stack.

The faceplate 36 is preferably angled to create a plurality of dispensing channels 84. Most preferably, the face plate has four dispensing channel 84 each connecting a pinch point 82 to the opening 73. The purpose of the dispensing channels 84 is to facilitate the travel of the corners of a napkin from the pinch points 82 to the opening 73 through the dispensing channels 84 when a user pulls on a presented napkin. The dispensing channels 84 relieve the pressure exerted on a napkin by the pinch points 82 when that napkin is pulled. The dispensing channels 84 also improve the dispensing of napkins by making up for imperfections in the alignment and fold of napkins in the dispenser 30.

As shown in FIGS. 9 and 10, the dispenser 30 may be modified to facilitate improved napkin dispensing by locating a pressure focus device 86 in juxtaposition with pressure plate 54. The pressure focus device 86 applies a constant pressure to the napkins in a particular, localized area as the pressure plate 54 travels along the rail 52. The pressure focus device 86 preferably cooperates with the faceplate 36 to maintain the napkins in normal alignment relative to the dispenser 30. The pressure focus device 86 may be formed integrally with the pressure plate 54 or maybe a separate piece that is removably attachable to the pressure plate 54 without the use of any tools. The pressure focus device 86 may be positioned at a variety of locations on the pressure plate 54. For example, in one embodiment, the pressure focus device 86 is positioned on the pressure plate 54 so that the pressure focus device 86 applies a force to the napkins at about the location of the opening 73 in the faceplate 36. In such case, the pressure focus device 86 is preferably shaped similarly to the opening 73 of the faceplate 36 to further concentrate the force applied to the napkins. The pressure focus device 86 may be selectively positionable on the pressure plate 54. For example, in one embodiment, the position of the pressure focus device 86 maybe changed as different faceplates with different openings are attached to the dispenser 30. Preferably, the pressure focus device 86 is selectively positionable without the use of any tools.

The dispenser 30 of the present invention may be utilized in a variety of manners with a variety of different types of napkins. For example, the dispenser 30 can be positioned at a variety of angles. The dispenser 30, with a track system 50, may be positioned relatively horizontal on a surface such as a countertop or at any appropriate dispensing position. Regardless of the position, the track system 50 provides the force necessary to urge the napkins towards the faceplate 36 so that they can be properly fed and presented for withdrawal by a user. The dispenser 30, without a track system, may be positioned relatively vertically on a surface such as a wall or on a mount as shown in FIG. 14. In these positions, gravity provides the force necessary to urge the napkins towards the faceplate 36 for proper feeding and presentment and the track system 50 may be omitted.

As shown in FIG. 11, the dispenser 30 is filled with napkins by opening the top portion 34. If a track system 50 is provided, the pressure plate 54 is slid along the rail 52 and moved away from the faceplate 36 and preferably engaged by the retention mechanism 58. Moving the pressure plate 54 away from the faceplate 36 unwinds the constant load spring thereby creating a substantially constant biasing force against the stack of napkins to be inserted as applied by the pressure plate 54. Once the napkins are positioned in the housing 32, the top portion 34 of the dispenser 30 is closed, automatically releasing the retention mechanism 58 by the action of the finger 66 on the trigger 64.

Once the top portion 34 is closed, the napkins are urged towards the faceplate 36 either by the track system 50 or gravity. As a napkin proceeds through the housing 32 toward the faceplate, it contacts ramp 74 when it first "enters" the faceplate 36. The ramp 74 lifts the napkin, as it moves toward the front, inside face of the faceplate 36, to the desired height and centers the napkin vertically in the middle of the faceplate 36. Each napkin also contacts indentations 76 as it enters the faceplate 36. These indentations pucker the napkin so that they have a slightly convex shape towards the opening 73 in the faceplate. Pinch points 82 engage each napkin within the area defined by the faceplate 36 to hold the sides of the napkins relatively straight both horizontally and vertically. The pinch points 82 are preferably coordinated with dispensing channels 84 that angularly connect the pinch points 82 to the opening 73 in the faceplate 36. The dispensing channels 84 relieve the pressure exerted on a napkin by the pinch points 82 as that napkin is pulled from the dispenser 30 through the opening 73. This pressure relief guides and facilitates smooth withdrawal of a napkin, proper presentment of the succeeding napkin and the ability to overcome imperfections in the alignment and fold of napkins in the dispenser 30.

In operation, a user removes napkins from the dispenser 30 by pulling on a napkin whose front unfolded edge is presented through the opening 73. The corners of the pulled napkin travel from the pinch points 82 through the dispensing channels 84 and out of the opening 73. In the case of interfold napkins, removing one napkin advances and presents the next napkin for removal from the dispenser 30. With full-fold napkins, the front flap of the front-most napkin in the stack is spaced apart from the body of the rest of the napkin thereby facilitating easy dispensing.

The next napkin is maintained in position by the pinch points 82 until pulled on by a user. For interfolded napkins, the opening 73 may be designed to prevent users from removing more than a predetermined amount of napkins. Specifically, the opening 73 may have two open areas 75 connected by a narrow aperture 77. Users can only access napkins though either or both open areas 75. As a result a user cannot stick his fingers into the dispenser and remove multiple napkins.

Figure 7:
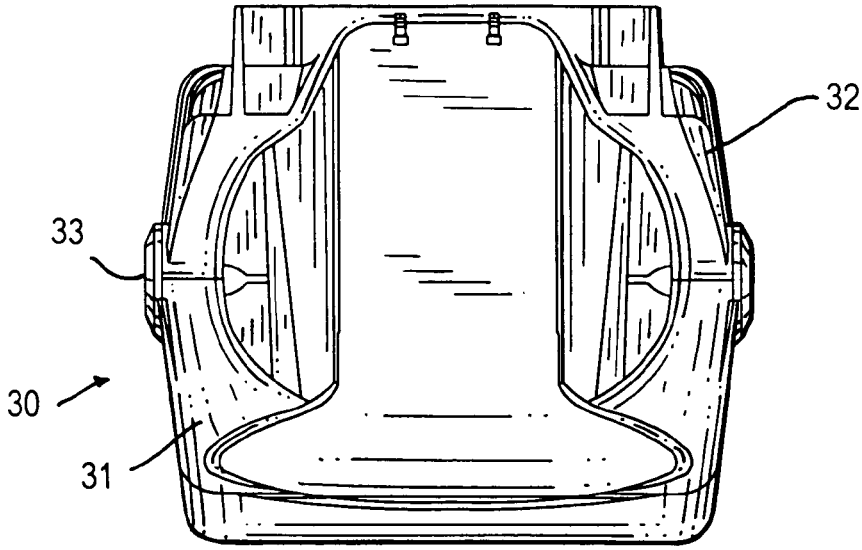
FIG. 7 is a rear plan view of the napkin dispenser of FIG. 1.

As discussed, the faceplate 36 and/or the track system 50 may be removed or attached to the dispenser 30 without the use of any tools. A tool-less removable faceplate 36 allows the dispenser 30 to easily accommodate different napkins. As shown in FIG. 7, the faceplate 36 may simply be removed from the dispenser 30 and another faceplate 36 attached to the dispenser 30.

A tool-less removable track system 50 allows the dispenser 30 to be positioned at a variety of angles. The track system 50 may be positioned in the dispenser 30 when the dispenser 30 is positioned relatively horizontal and the track system may be removed with the dispenser 30 is positioned relatively vertical. In one embodiment shown in FIGS. 12 and 13, the rail 52 of the track system 50 snap fits into the bottom portion 31 of the dispenser 30. As shown in FIG. 12, the rail 52 has rear retaining hooks 100 and a front retaining hook 101. As shown in FIG. 13, the bottom portion 31 has rear retaining slots 103 and a front hook retainer 105. The track system 50 is snap fit into the bottom portion 31 by sliding the rear retaining hooks 100 into rear retaining slots 103 in the bottom portion 31. The track system 50 is lowered until the front retainer hook 101 contacts the front hook retainer 105. A force is applied to the track system 50, thereby snapping the front retainer hook 101 into the front hook retainer 105. The track system 50 may be removed from the dispenser 30 by disengaging the front retainer hook 101 from the front hook retainer 105, lifting the track system 50, and sliding the rear retaining hooks 100 out of the rear retaining slots 103, without the use of tools.

The dispenser 30 of the present invention may have other applications aside from use in connection with napkins. Further, the invention may be implemented in a variety of configurations, using certain features or aspects of the several embodiments described herein and others known in the art. Thus, although the invention has been herein shown and described in what is perceived to be the most practical and preferred embodiments, it is to be understood that the invention is not intended to be limited to the specific features and embodiments set forth above. Rather, it is recognized that modifications may be made by one of skill in the art of the invention without departing from the spirit or intent of the invention and, therefore, the invention is to be taken as including all reasonable equivalents to the subject matter of the claims.

We claim:

1. A dispenser comprising:

a housing, for holding a plurality of napkins to be dispensed, wherein said housing has an interior and an exterior, a front, a rear portion, a top and a bottom; and a track system in said housing for biasing napkins held in said housing toward the front of said housing wherein said track system comprises a biased pressure plate guided by a single rail connected, with a snap-fit connection, to at least a portion of the interior of said housing.

2. A dispenser comprising:

a housing for holding a plurality of napkins to be dispensed, wherein said housing has an interior and an exterior, a front, a rear portion, a top and a bottom;

a faceplate mounted to the front of the housing and adapted to dispense napkins;

a track system in said housing for biasing napkins held in said housing toward the front of said housing wherein said track system comprises a biased pressure plate guided by a single rail connected to at least a portion of the interior of said housing, said rail sitting generally along a central longitudinal axis extending between the front and the rear portion; and wherein the single rail has a curved end proximate the front of the housing.

3. The dispenser of claim 2 wherein the track system includes a constant force spring associated with the biased pressure plate and operative to bias the biased pressure plate toward the front of the housing.

4. The dispenser of claim 2 wherein the single rail is removably mounted to the bottom of the housing.

5. The dispenser of claim 2 wherein the biased pressure plate comprises:

a rear face;

a pair of upright flanges extending from the rear face and adjacent opposite sides of the single rail;

a first roller coupled to a first upright flange and a second roller coupled to a second upright flange; and wherein the first and the second rollers are designed to roll along a top surface of the single rail as the biased pressure plate is translated between the front and the rear portion of the housing.

6. The dispenser of claim 2 wherein the biased pressure plate has a front face and a pressure focus feature mounted to the front face, the pressure focus feature designed to press against a napkin when the napkin is loaded within the interior of the housing.

7. The dispenser of claim 6 wherein the pressure focus feature includes an elongated member mounted to the front face at an angle orthogonal to the central longitudinal axis.

8. The dispenser of claim 6 wherein the front face include multiple sets of mounting points to which the pressure focus feature may be mounted to allow variability in positioning of the pressure focus feature.

9. The dispenser of claim 2 wherein the faceplate is removably mounted to the front of the housing in a manner that allows interchangeable faceplates to be mounted to the front of the housing.

10. A dispenser for dispensing interfolded and non-interfolded napkins, comprising:

a housing having an interior volume defined by front, a rear, a pair of sidewalls, a bottom, and a cover, wherein the cover is hingedly coupled to the rear to allow selective access to the interior volume when the cover is pivoted rearward away from the front;

a rail assembly removably mounted to the bottom of the housing and having a first end adjacent the rear of the housing and a second end proximate the front of the housing, wherein the second end is curved relative to the first end;

a biasing assembly contained within the interior volume and removably mounted to the rail assembly, the biasing assembly including a pressure plate translatable along the rail assembly and a constant force spring that biases the pressure plate toward the front of the housing.

11. The dispenser of claim 10 wherein the rail assembly includes a single rail extending between the front and the rear of the housing.

12. The dispenser of claim 10 further comprising a pressure focus feature variably positioned to a napkin-side of the pressure plate.

13. The dispenser of claim 10 wherein the bottom is configured to support the dispenser on a support surface, and wherein the front of the housing is curved so that a napkin extending through the front does not contact the support surface.

14. The dispenser of claim 10 wherein the front includes a removable faceplate.

15. A dispenser for dispensing napkins, comprising:

a housing defining an interior volume adapted to be loaded with napkins;

a faceplate remvovably attached to the housing;

a cover coupled to the housing and pivotable relative to the housing between a closed position and an open position, wherein napkins may be loaded into the housing when the cover is in the open position; and a biasing assembly adapted to bias napkins stored in the housing toward the faceplate, wherein the biasing assembly includes a curved rail and a pressure plate movable along the curved rail, wherein the pressure plate is lockable at a first position when napkins are being loaded into the housing and has an actuator that interfaces with the cover to automatically release the pressure plate when the cover is returned to a closed position to allow the pressure plate to move along the rail toward the faceplate to bias the napkins.

16. The dispenser of claim 15 wherein the curved rail is a single rail that is removably mounted to the housing.

17. A dispenser comprising:

a housing defining an interior volume adapted to be loaded with product to be dispensed;

a faceplate associated with the housing and defining an opening through which the product may be dispensed; and a biasing assembly that biases product loaded in the housing toward the faceplate, the biasing assembly including a pressure plate movable along a longitudinal axis of the housing and a pressure focus feature forming a part of the pressure plate, wherein the pressure plate defines multiple pressure focus feature mounting positions and wherein the pressure focus feature is mountable to the pressure plate and is selectively movable between the multiple pressure focus feature mounting positions to allow a user to position the pressure focus feature at any selected one of the multiple mounting positions.

18. The dispenser of claim 17 wherein the pressure focus feature is removably coupled to the pressure plate.

19. The dispenser of claim 17 wherein the product to be dispensed is interfolded napkins.

20. The dispenser of claim 17 wherein the faceplate is one of a number of faceplates that may be interchangeably coupled to the housing, and wherein the pressure focus feature is mounted to the faceplate at a position corresponding to a position of the opening of the faceplate.

21. A dispenser comprising:

a housing defining an interior volume adapted to he loaded with product to be dispensed;

a faceplate associated with the housing and defining an opening through which the product may be dispensed; and a biasing assembly that biases product loaded in the housing toward the faceplate, the biasing assembly including a pressure plate movable along a longitudinal axis of the housing and a pressure focus feature forming a part of the pressure plate, and wherein the pressure focus feature may be removed and attached to the faceplate in a tool-less manner.

* * * * *